United States Patent [19]

Jensen et al.

[11] Patent Number: 4,784,419

[45] Date of Patent: Nov. 15, 1988

[54] COIL PROTECTOR FOR "C" HOOKS

[75] Inventors: Jorn E. Jensen, Leechburg; Roy C. Bongartz, Indiana Township, Allegheny County, both of Pa.

[73] Assignee: Allegheny Ludlum Corporation, Pittsburgh, Pa.

[21] Appl. No.: 163,447

[22] Filed: Mar. 3, 1988

[51] Int. Cl.[4] ..... B66C 1/54

[52] U.S. Cl. ..... 294/67.2; 294/103.2

[58] Field of Search ..... 294/67.2, 103.2, 86.4, 294/119.3, 88, 104, 106, 98.1, 92, 119.2, 86.32, 87.12, 99.1; 414/621, 729, 741, 742, 910

[56] References Cited

U.S. PATENT DOCUMENTS 2,675,261 4/1954 Egge ..... 294/103.2

3,291,519 12/1966 Burke ..... 294/67.2

4,641,876 2/1987 Kiser et al. ..... 294/103.2

4,717,188 1/1988 Johnston ..... 294/103.2

*Primary Examiner*—James B. Marbert

*Attorney, Agent, or Firm*—Patrick J. Viccaro

[57] ABSTRACT

A coil protector for "C" hooks includes a pad of cushioning material secured to by straps in spaced slots to the "C" hook. Reinforcing mesh material is molded into the pad between the slots and the vertical leg to which the pad is to be secured to prevent tearing of the pad by straps. The pad is preferably molded from urethane or some similar cushioning material; and the reinforcing mesh material; is preferably a welded steel wire cloth, expanded metal, or a high strength abrasion resistant fiber.

7 Claims, 2 Drawing Sheets

COIL PROTECTOR FOR "C" HOOKS

BACKGROUND OF THE INVENTION

1. Field of the Invention: While not limited thereto, the present invention is particularly adapted for use with a so-called "C" hook used in the steel industry to lift and transport steel coils. The hook is usually made from steel plate and, as the name implies, is generally C-shaped in configuration, having a vertical portion with upper and lower horizontal legs projecting therefrom when the hook is suspended from an overhead crane. The horizontal upper leg has a clevis attached to the "C" hook at its approximate center or balance point such that a crane hook may be inserted into the clevis for lifting. The bottom leg of the hook is inserted into the central opening of a steel coil such that when the hook is lifted by the crane, it will carry with it the coil which rests on the lower leg.

2. Prior Art: Disclosed in U.S. Pat. No. 3,291,519 is a sliding bumper constructed to slide along tracks on vertical parts of a "C" hook. The bumper is yeildingly biased to normal position relative to the "C" hook so that the bumper is free to be held by the coil as the arm moves up or down in the eye of the coil. However, exposed right angle corners on the bumper are reduced and can damage coil wrap edges. Upon impact, also the bumper can be damaged upon impact with the coil but cannot be costly replaced. As can be understood, the lower leg of the "C" hook is inserted into the central opening of a coil while suspended from the overhead crane. The hook is typically formed from about a 3 inch steel plate and, consequently, is quite heavy. It often happens that the forward face of the vertical portion of the hook slams against the side of the coil while the vertical leg is being introduced into the central opening of the coil. The rear face of the vertical portion can also slam against coils in storage. This can cause damage to the edges of the strip material, even though the edges might be perfectly aligned.

In the past, the edges or faces of the vertical portion of such a "C" hook have been provided with a cushioning material, such as molded urethane, to prevent damage to a steel coil either carried on the hook or in storage. The cushioning pad is provided with horizontal slots extending through its mid-portion. These slots receive steel straps which extend around the vertical leg portion to secure the pads in place.

While a pad of the type described above is quite effective to prevent damage to the edges of a coiled strip, it has been found that the steel bands which extend through the slots in the pad tear the pad in the areas of the slots. This occurs long before the wear surface of the pad is worn out, resulting in frequent replacement, as frequent as each week when the hook is used 24 hours a day.

SUMMARY OF THE INVENTION

In accordance with the present invention, a pad of cushioning material, adapted to be secured to an object by straps, has spaced slots extending therethrough for receiving the straps. Reinforcing mesh material is molded into the pad between the slots and the object to which the pad is to be secured to prevent tearing of the pad by the straps.

Thus, by inserting a reinforcing pad into the molded pad, the straps will no longer tear the cushioning material in the areas of the slots.

The pad is preferably molded from urethane 90 durometer or some similar cushioning material; and the reinforcing mesh material is preferably a welded steel wire cloth, expanded metal, or a high strength abrasion resistant fiber. As mentioned above, the invention is particularly adapted for use as a cushioning material for the vertical leg of a "C" hook to prevent damage to coiled strip material.

The above and other objects and features of the invention will become apparent from the following detailed description taken in connection with the accompanying drawings which form a part of this specification in which.

DETAILED DESCRIPTION OF THE DRAWINGS

Figure 1:
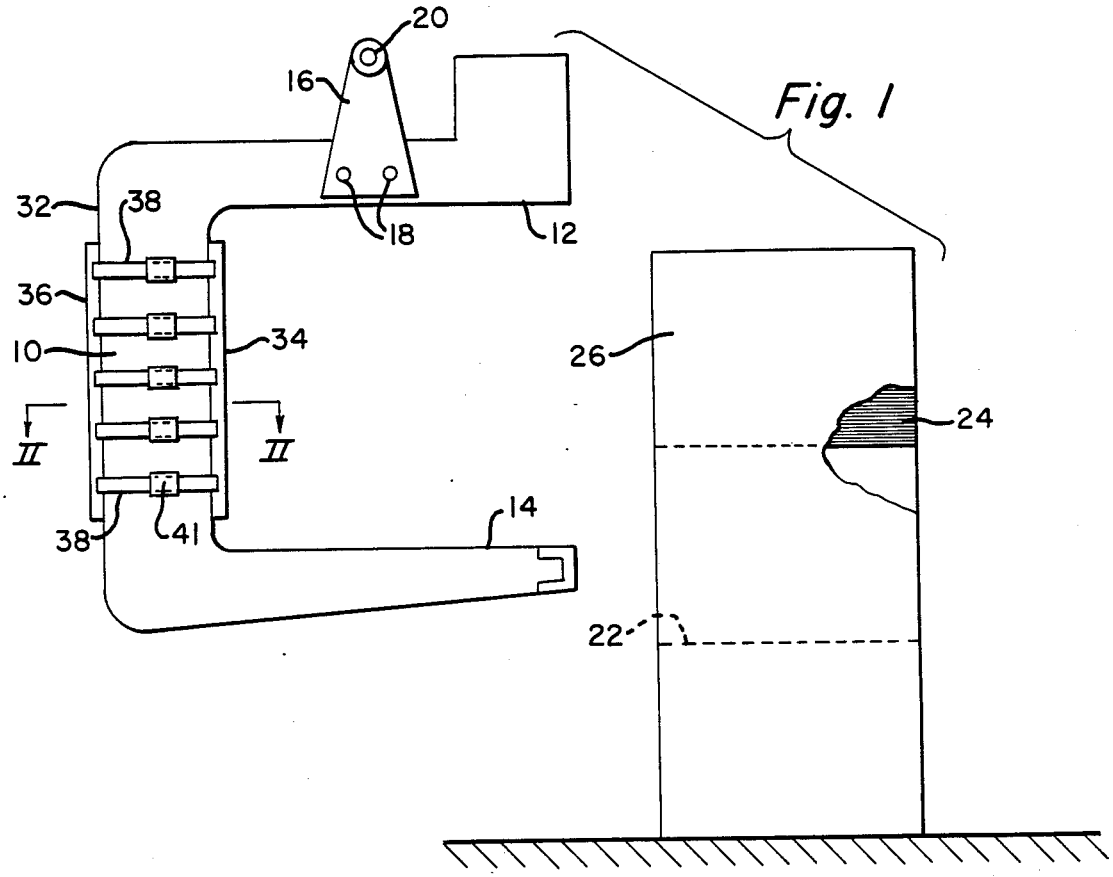
FIG. 1 is a side view of a typical "C" hook having the coil protector of the present invention secured thereto.
Figure 2:
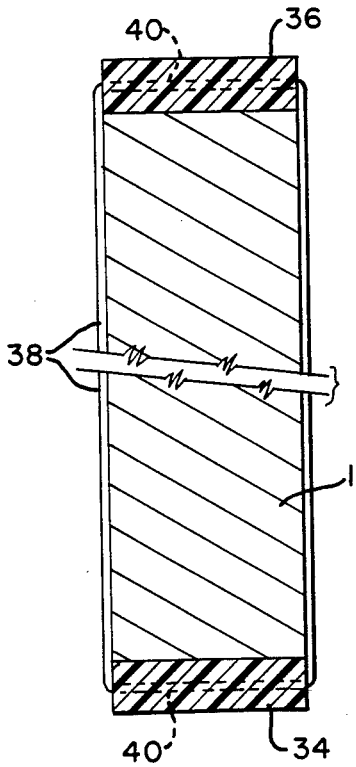
FIG. 2 is a cross sectional view taken substantially along line II—II of FIG. 1.

With reference of the drawings, and particularly to FIGS. 1 and 2, the "C" hook shown comprises a vertical portion 10 having a horizontal upper leg 12 and a lower leg 14 projecting therefrom. A clevis 16 is secured to the upper leg 12 by means of bolts 18 or other fastening elements and is provided with an upper hinge pin 20 which is engaged by an overhead crane hook, not shown. The lower leg 14 is inserted into the central, circular opening 22 of coiled strip material 24, the arrangement being such that as the lower leg 14 is moved to the opening 22 and then lifted upwardly by an overhead crane, the upper surface of the leg 14 will engage the periphery of the central opening 22 to lift the coil also. When a coil is deposited at another location within the mill, the forgoing process is reversed to remove the lower leg 14 from the opening 12.

As was explained above, it often happens that the forward face 30 of the "C" hook slams into the side 26 of the coiled strip material, thereby causing damage to the edges of the strip even though they might be perfectly aligned. Additionally, the rear face 32 of the vertical portion 10 may slam against coils which are, for example, in a storage location, causing the same type of damage to the edges of the coiled strip.

In order to prevent the aforesaid damage, cushioning pads 34 and 36 of plastic material or the like are secured to the forward and rear surfaces 30 and 32 of the vertical leg portion 10 such that when the portion 10 slams into the side of the coil, the pads 34 and 36 will prevent damage to the edges of the strip. The pads 34 and 36 are secured in place by metal straps 38 which pass through slots 40 (FIG. 2) in the pads 34 and 36 and are drawn taught and clamped by means of strapping clamps 41 on the side of the vertical leg 10 of the "C" clamp.

Figure 3:
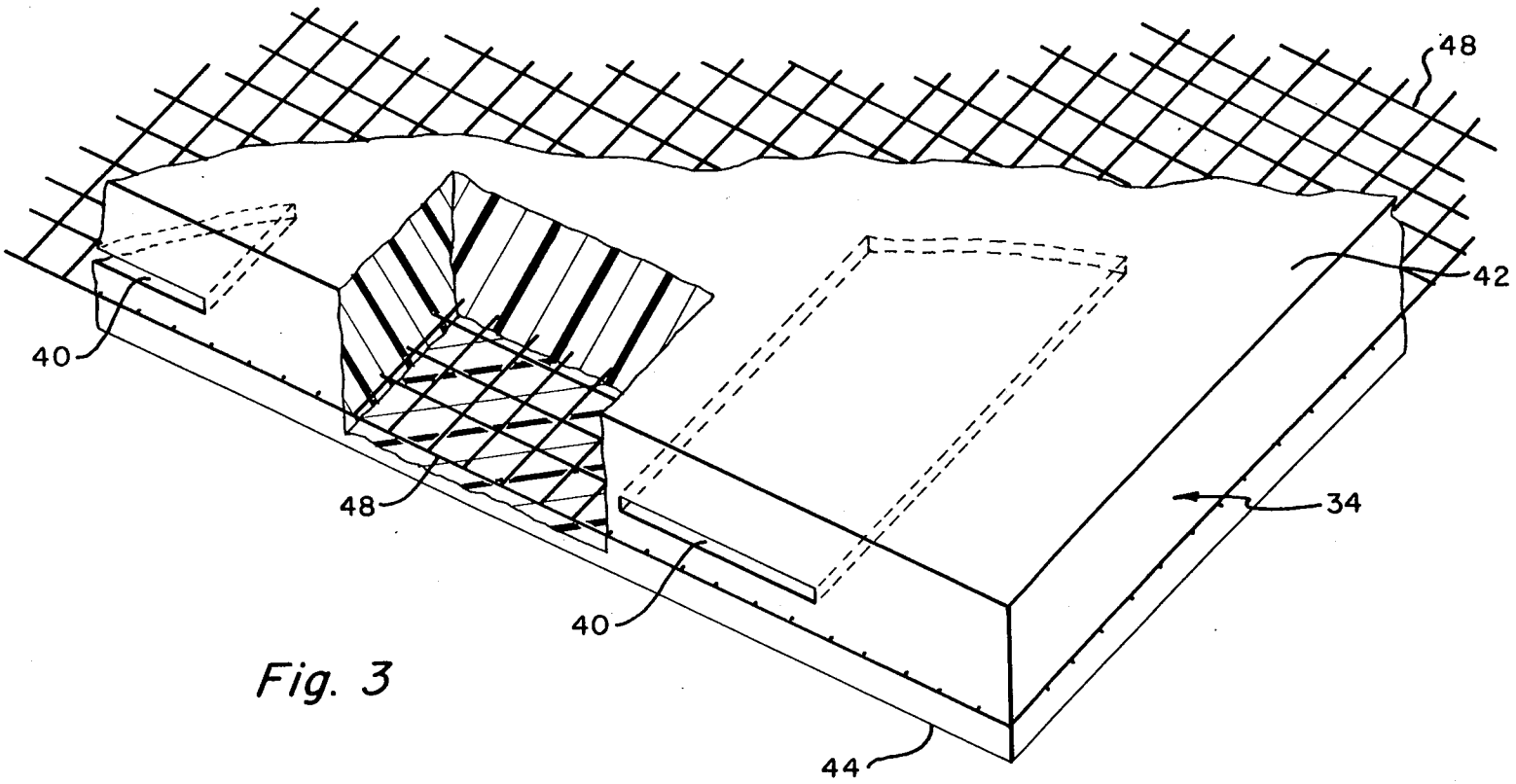
FIG. 3 is a partially broken away perspective view of the cushioning pad of the present invention showing the manner in which reinforcing material is inserted between slots extending through the pad and the object to which the pad is to be secured.

The details of the pad 34, for example, are shown in FIG. 3. The pad itself is formed from a moldable plastic material such as urethane, typically having a thickness of about 1 inch, and a hardness of 90 durometers. Between the top 42 and bottom 44 of the pad are the molded slots 40 which are adapted to receive the straps 38. The slots are typically 1½ inches wide and are spaced apart by a distance of about 6 inches.

As was explained above, when the straps are inserted through the slots 40 in prior art pads of this type, the straps tend to tear the plastic urethane material in the area of the slots between the slot itself and the faces 30 and 32, for example. Therefore, in accordance with the present invention, reinforcing mesh material 48 is molded into the pad 3 between the slots 46 and the lower face 44 which, in a typical application, will engage one of the faces 30 or 32 on the vertical leg portion 10 shown in FIG. 1. Mesh material 48 may comprise welded steel wire cloth of ¼ inch grid or, or diamond opening, expanded metal mesh or alternatively, may comprise a high strength abrasion resistant fiber such as nylon or Aramid (TM) fiber. In a typical application, the thickness of the pad 34 is 1 inch as mentioned above, the slots 46 are spaced approximately ½ inch from the upper and lower surfaces 42 and 44 of the pad, and the reinforcing mesh material 48 is spaced ¼ inch from the lower face of the pad which engages an object to which it is to be secured.

With this arrangement, the reinforcing mesh material prevents the straps 38 from cutting through the plastic material from which the pad is formed, thereby lengthening the life of the pad and insuring that the pad will not have to be discarded before its outer surface 42, which engages a coil, is worn down.

While the invention has been shown in connection with a certain specific embodiment, it will be readily apparent to those skilled in the art that various changes in form and arrangement of parts may be made to suit requirements without departing from the spirit and scope of the invention.

What we claim is:

1. A pad of cushioning material adapted to be secured to an object by straps, said pad having spaced slots extending therethrough for receiving said straps, and reinforcing mesh material molded into the pad between the slots and the object to which the pad is to be secured to prevent tearing of the pad by the straps.

2. The pad of claim 1 wherein said reinforcing mesh material comprises welded steel wire cloth, or expanded metal.

3. The pad of claim wherein said reinforcing mesh material comprises a high strength, abrasion resistant fiber formed from plastic material.

4. The pad of claim 1 wherein said slots extend parallel to a surface of the object to which the pad is to be secured and substantially midway between the surface of the pad which engages said object and its opposing surface.

5. The pad of claim 4 wherein said reinforcing mesh material is molded into the pad substantially midway between said slots and the surface of said object adapted to be engaged by the pad.

6. An assembly for the vertical leg of a "C" hook to prevent damage to coiled strip material, comprising a pad of shock absorbing material secured to a face of said vertical leg such that the shock absorbing material will engage the side of a coil which would otherwise be engaged by said vertical portion, vertically-spaced slots extending through the interior of said pad, fastening straps extending through said slots and around said vertical portion of the "C" hook to hold the pad in place on said face of said vertical leg, and reinforcing mesh material molded into the pad between the slots and said face of the vertical leg to prevent tearing of the pad by the straps.

7. The assembly of claim 6 wherein there are pads of shock absorbing material on both the inner and outer faces of the vertical portion of said "C" hook.

* * * * *